US008713945B2

(12) United States Patent
Kuppusamy

(10) Patent No.: US 8,713,945 B2
(45) Date of Patent: May 6, 2014

(54) LINER AFT END SUPPORT MECHANISMS AND SPRING LOADED LINER STOP MECHANISMS

(75) Inventor: Balasundar Kuppusamy, Karnataka (IN)

(73) Assignee: Nuovo Pignone S.p.A., Florence (IT)

( * ) Notice: Subject to any disclaimer, the term of this patent is extended or adjusted under 35 U.S.C. 154(b) by 837 days.

(21) Appl. No.: 12/825,543

(22) Filed: Jun. 29, 2010

(65) Prior Publication Data

US 2011/0314829 A1 Dec. 29, 2011

(51) Int. Cl.
*F02C 1/00* (2006.01)
*F02G 3/00* (2006.01)

(52) U.S. Cl.
USPC ..... 60/752; 60/753; 60/754; 60/755; 60/756; 60/757; 60/758; 60/760; 60/800; 60/805; 60/806

(58) Field of Classification Search
USPC ..... 60/752–760, 800, 805, 806
See application file for complete search history.

(56) References Cited

U.S. PATENT DOCUMENTS

| | | | | |
|---|---|---|---|---|
| 2,547,619 | A * | 4/1951 | Buckland | 60/796 |
| 4,696,431 | A | 9/1987 | Buxe | |
| 5,323,600 | A | 6/1994 | Munshi | |
| 5,623,600 | A | 4/1997 | Ji et al. | |
| 5,749,218 | A | 5/1998 | Cromer et al. | |
| 6,216,442 | B1 * | 4/2001 | Belsom et al. | 60/797 |
| 6,279,313 | B1 * | 8/2001 | Lawen et al. | 60/797 |
| 7,152,411 | B2 * | 12/2006 | McCaffrey et al. | 60/796 |
| 7,269,957 | B2 | 9/2007 | Martling et al. | |
| 7,555,906 | B2 | 7/2009 | Anichini et al. | |
| 2006/0130486 | A1 * | 6/2006 | Danis et al. | 60/752 |
| 2008/0179837 | A1 | 7/2008 | Ryan | |
| 2009/0044540 | A1 * | 2/2009 | Pangle et al. | 60/752 |
| 2009/0120093 | A1 * | 5/2009 | Johnson et al. | 60/752 |
| 2010/0005803 | A1 | 1/2010 | Tu et al. | |

FOREIGN PATENT DOCUMENTS

JP 8285284 A 11/1996

* cited by examiner

*Primary Examiner* — Craig Kim
(74) *Attorney, Agent, or Firm* — Global Patent Operation

(57) ABSTRACT

A gas turbine includes a liner, a casing surrounding the liner, a hula seal flexibly connected to an aft end of the liner and a liner aft support mechanism. The liner is configured to receive compressed gas and fuel at an upstream end, the mixture of the compressed gas and the fuel being burned in a combustion core area of the liner to yield hot exhaust gasses. The liner aft end support mechanism is located downstream from an area where a highest temperature on an outer surface of the liner is attained, and upstream to a portion where the hula seal is connected to the liner, and is configured to movably support the liner inside the casing. The liner aft end support mechanism includes at least three individual support elements configured to allow a part of the individual support elements to move in the flow direction relative to at least one of the liner or the casing.

18 Claims, 11 Drawing Sheets

LINER AFT END SUPPORT MECHANISMS AND SPRING LOADED LINER STOP MECHANISMS

BACKGROUND

1. Technical Field

Embodiments of the subject matter disclosed herein generally relate to mechanisms for supporting a liner in a gas turbine, and more particularly, to liner aft end support mechanisms and spring loaded stop liner support mechanisms.

2. Discussion of the Background

In a conventional gas turbine 100 as illustrated in FIG. 1, gases flow from a compressor 110 to a turbine 120 in a gas flow direction 125. The compressor 110 outputs compressed air 127 which is then mixed with fuel 129 input through gas nozzles (not shown). The mixture of air and fuel is burned yielding exhaust gases in a combustion process. The combustion process may occur inside a liner 130. Sometimes, the combustion process occurs inside a combustion chamber (i.e., a component between the compressor and the turbine dedicated to the combustion process) and a liner is used to confine the hot exhaust gases output from the combustion chamber on their path towards the turbine.

The compressed air and fuel are input and mixed at a stop end 135 of the liner 130. The exhaust gases are output through an aft end 140 of the liner 130. The aft end 140 is downstream in the gas flow direction 125 from the stop end 135. The exhaust gases resulting from the combustion are hot causing a thermal expansion of the liner 130. In order to accommodate this expansion, a flexible component, such as, a hula seal 150 is mounted downstream from the liner 130, in the gas flow direction 125. The hula seal 150 allows the aft end 140 of the liner 130 to move along the gas flow direction 125 when a length of the liner 130 is altered due to the thermal expansion.

When the combustion occurs inside the liner 130, the stop end 135 of the liner 130 has a relatively fixed position. Therefore, a liner stop support mechanism 160 is frequently mounted close to the stop end 135, between the liner 130 and a support structure such as a casing (not shown). In contrast, the aft end 140 tends to move along the gas flow direction when the thermal expansion occurs. Therefore, conventionally, no support mechanism is mounted at the aft end 140 of the liner 130.

FIG. 2 schematically illustrates a portion of a gas turbine 200. Gasses flow in a flow direction 205 inside a liner 210 of the gas turbine 200. Compressed air 212 and fuel 213 are mixed inside the liner 210 at a stop end 214. The mixture of compressed air and fuel is burned in a combustion core area 215 of the liner 210. The exhaust gases 216 result from burning the mixture of air and fuel flow from the combustion core area 215 and are output at an aft end 217 of the liner 210. A hula seal (not shown) usually confines the exhaust gases exiting the liner 210 through the aft end 217.

Inside the gas turbine 200, the compressed air 212 enters a space between the liner 210 and a casing 220 surrounding the liner at the aft end and flows towards the stop end where the compressed air is guided inside the liner 210. This manner of guiding the compressed air has the advantage that the compressed air may cool the liner 210. The manner of guiding the compressed air 212 to the stop end 214 of the liner 210 is a design choice. In other embodiments, such as in FIG. 1, the compressed air may be fed inside the liner in other manners.

From an operating temperature point of view, the liner 210 has a liner cold zone 222 located upstream in the flow direction 205 from the combustion core area 215, and a liner hot zone 224 located downstream in the flow direction 205 from the combustion core area 215. Inside the liner 210, the highest gas temperatures are attained in the combustion core area 215. In a first region 226 surrounding the combustion core 215, the gas has temperatures lower than the temperatures in the combustion area. In a second region 227 surrounding the first region 226, the gas has temperatures lower than in the first region 226. In a third outer region 228 surrounding the second region 227, the gas has temperatures lower than temperatures of the second region 227. A person of ordinary skill in the art would understand that the regions 226, 227 and 228 merely illustrate varying gas temperatures inside the liner 210, but no physical separation exists between these regions, the temperature varying continuously inside these regions and across region borders. Also, those skilled in the art would understand that more or less temperature regions may exist.

Heat and vibration from the combustion process, as well as other mechanical loads and stresses from the gas turbine shake, rattle and otherwise cause vibrations of the liner and the other components of the gas turbine in the proximity of the liner. Accordingly, the liner should be mounted such as to withstand the heat, vibration and loads imposed by the combustion and other forces.

A liner stop support mechanism 230 may be mounted between the liner 210 and the casing 220, close to the stop end 214, in the cold zone 222 of the liner 210. Due to its location in the cold zone 222 (where no significant thermal expansion occurs), the liner stop support mechanism 230 connects points relatively fixed on an inner surface of the casing 220, and on an outer surface of the liner 210.

A typical liner stop support mechanism is illustrated in FIG. 3A. The liner stop support mechanism of FIG. 3A includes three individual support elements 350, 352, and 354 disposed between the liner 310 and the casing 320, around a section substantially perpendicular on the flow direction 305.

Each individual support element, e.g., 352 in FIG. 3B, is inserted between pairs of points, one point being located on an inner surface 360 of the casing 320, and the other one being located on an outer surface 370 of the liner 310.

One individual support may have a male part 380 as illustrated in FIG. 3C and a female part 390 as illustrated in FIG. 3D. The male part 380 and the female part 390 are assembled in the manner illustrated in FIG. 3E. A problem with this type of individual support elements is that often contact occurs only between one face of the male part 380 and the female part 390, and this phenomenon leads to uneven wear of the individual support elements.

As mentioned above, due to the hot exhaust gases a thermal expansion of the liner (e.g., 130, 210 or 310) occurs. The thermal expansion of the liner has the effect that the aft end is not held in a fixed position, which prevents the use of a conventional support mechanism at the aft end of the liner (downstream on the flow direction) to which a hula seal is attached. In absence of such a support mechanism, the hula seal supports a substantial load and has more freedom to move than necessary, which leads to a short life cycle of the hula seal and instability in operation.

Accordingly, it would be desirable to provide additional support to a liner and to alleviate the uneven wear of individual support elements in a liner stop support mechanism, thereby avoiding the afore-described problems and drawbacks.

SUMMARY

According to an embodiment, a gas turbine includes a liner, a casing configured to surround the liner, a hula seal configured to be flexibly connected to the aft end of the liner, and a liner aft end support mechanism. The liner is configured to receive compressed gas and fuel at an upstream end in a flow direction, a mixture of the compressed gas and the fuel being burned in a combustion core area of the liner, and to output exhaust gasses being output at an aft end opposite to the upstream end in the flow direction. The hula seal is configured to receive the exhaust gasses. The liner aft end support mechanism may be located downstream from an area where a highest temperature on an outer surface of the liner is attained and upstream from a portion where the hula seal is connected to the liner. The liner aft end support mechanism may be configured to movably support the liner inside the casing, and includes at least three individual support elements configured to allow a part of the individual support elements to move in the flow direction relative to at least one of the liner or the casing.

According to another embodiment, a liner support system includes an aft support mechanism having at least three individual support elements located between a liner and a casing close to a liner aft end of the liner, downstream from an area where a highest temperature on an outer surface of the liner is attained, and upstream from a portion where a hula seal is connected to the liner, in a gas flow direction. The individual support elements may be configured to maintain support of the liner aft end, and to allow a part of the individual support elements to slide in the flow direction relative to at least one of the liner or the casing.

According to another embodiment, a gas turbine has a compressor configured to compress air, a turbine section downstream from the combustion chamber in a flow direction configured to receive a gas flow, a liner fluidly connected between the compressor and the turbine section, a casing configured to be fixedly connected to a gas turbine support structure and to surround the liner, a hula seal connected to the aft end of the liner and the turbine section, and a liner stop support mechanism located at a forward section of the liner. The liner may be configured to receive the compressed air and fuel, a mixture of the compressed air and fuel burning inside the liner and yielding hot exhaust gasses, the liner having an upstream end fixedly supported and an aft end opposite to the upstream end, downstream in the flow direction. The liner stop support mechanism may be configured to support the liner inside the casing, and may include at least three male-female support elements, one of a female part and a male part of the male-female support elements welded to the casing and another one of the female part and the male part of the male-female support elements being welded to the liner. Each of the male-female support elements may have a first spring between a first surface of the male part and a first inner surface of the female part, and a second spring between a second surface of the male part opposite to the first surface, and a second inner surface of the female part the first and the second springs exerting elastic forces on respective surfaces of the male part and the female part, respectively, substantially perpendicular to an insertion direction of the male part into the female part.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a gas turbine. However, the embodiments to be discussed next are not limited to these systems, but may be applied to other systems that support a liner through which hot gases are exhausted.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
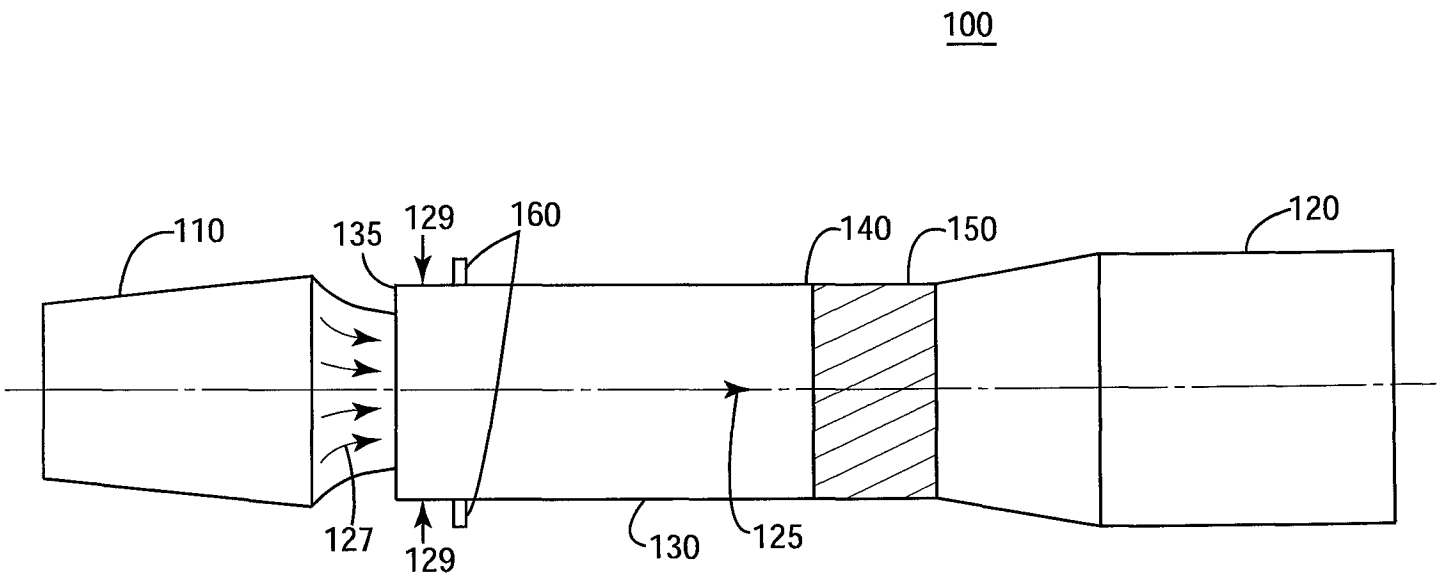
Figure 1 (Background Art)
FIG. 1 is a schematic diagram of a conventional gas turbine.
Figure 2:
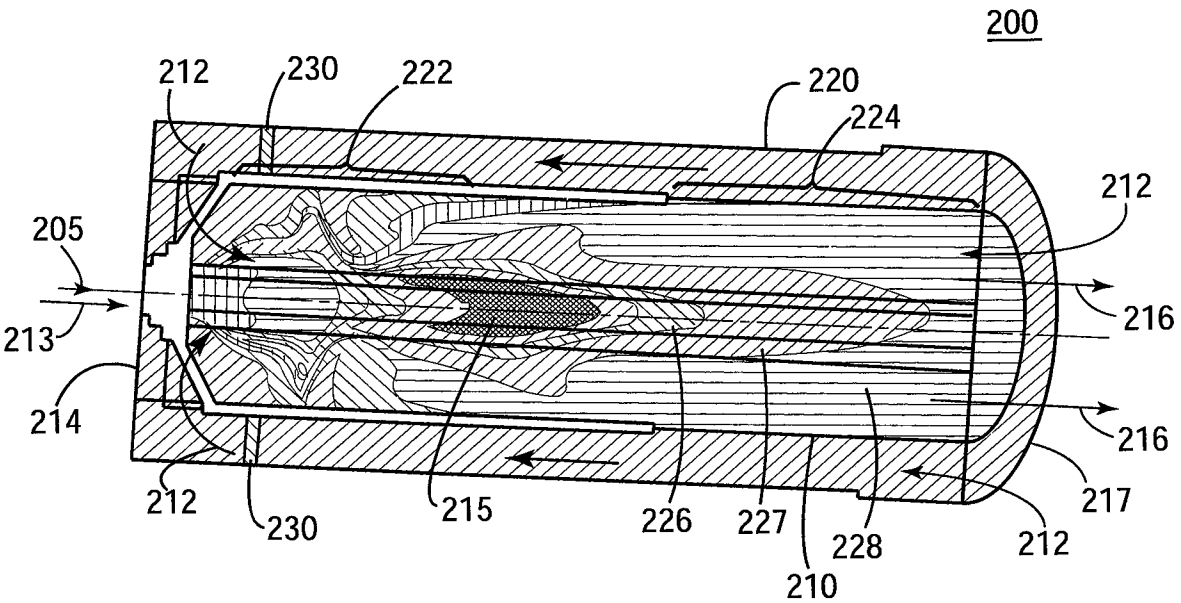
Figure 2 (Background Art)
FIG. 2 is a schematic partial diagram of a conventional gas turbine.
Figure 3A:
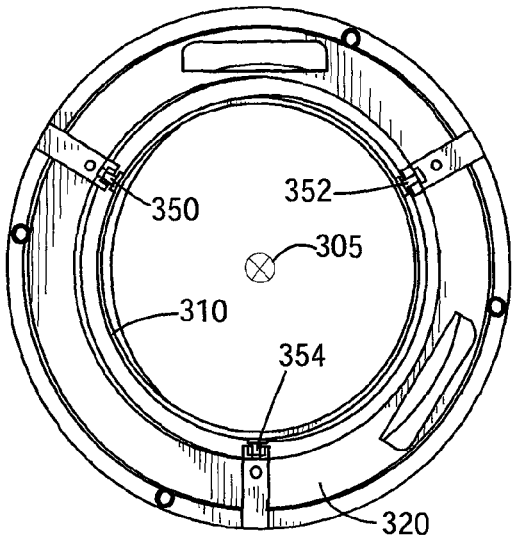
FIG. 3A is a schematic typical liner stop support mechanism between a liner and a casing.
Figure 3B:
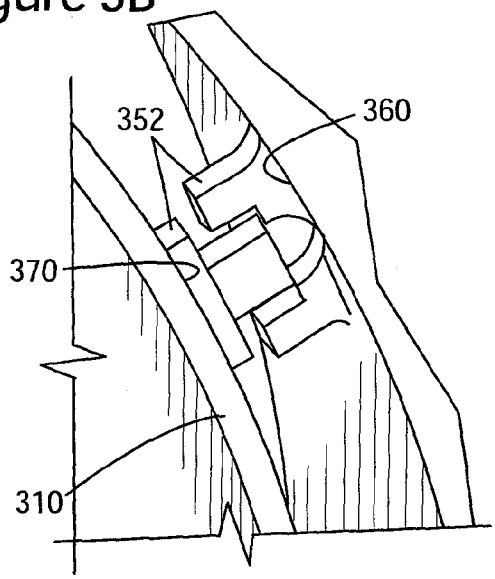
FIG. 3B illustrates an individual support element of the liner stop support mechanism in FIG. 3A.
Figure 3C:
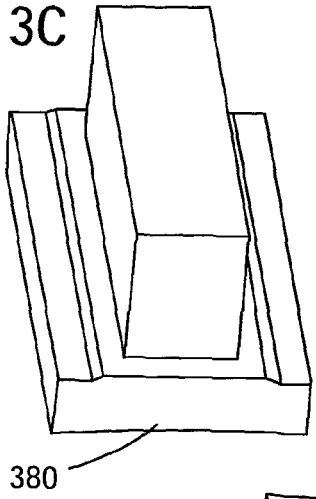
FIG. 3C is a male part of the individual support element in FIG. 3B.
Figure 3D:
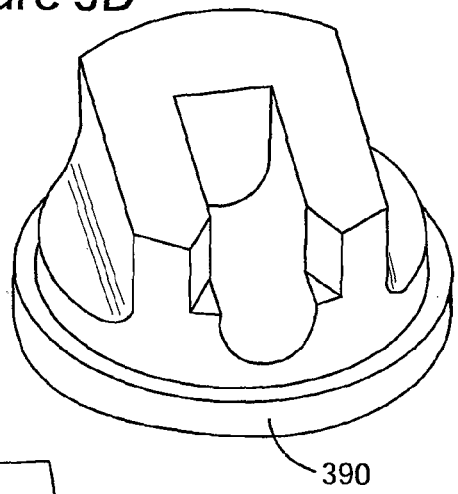
FIG. 3D is a female part of the individual support element in FIG. 3B.
Figure 3E:
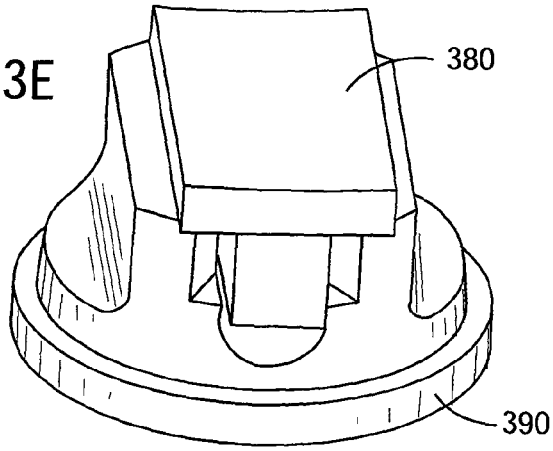
FIG. 3E illustrates the manner in which the male part in FIG. 3C and the female part in FIG. 3D are assembled.
Figure 4:
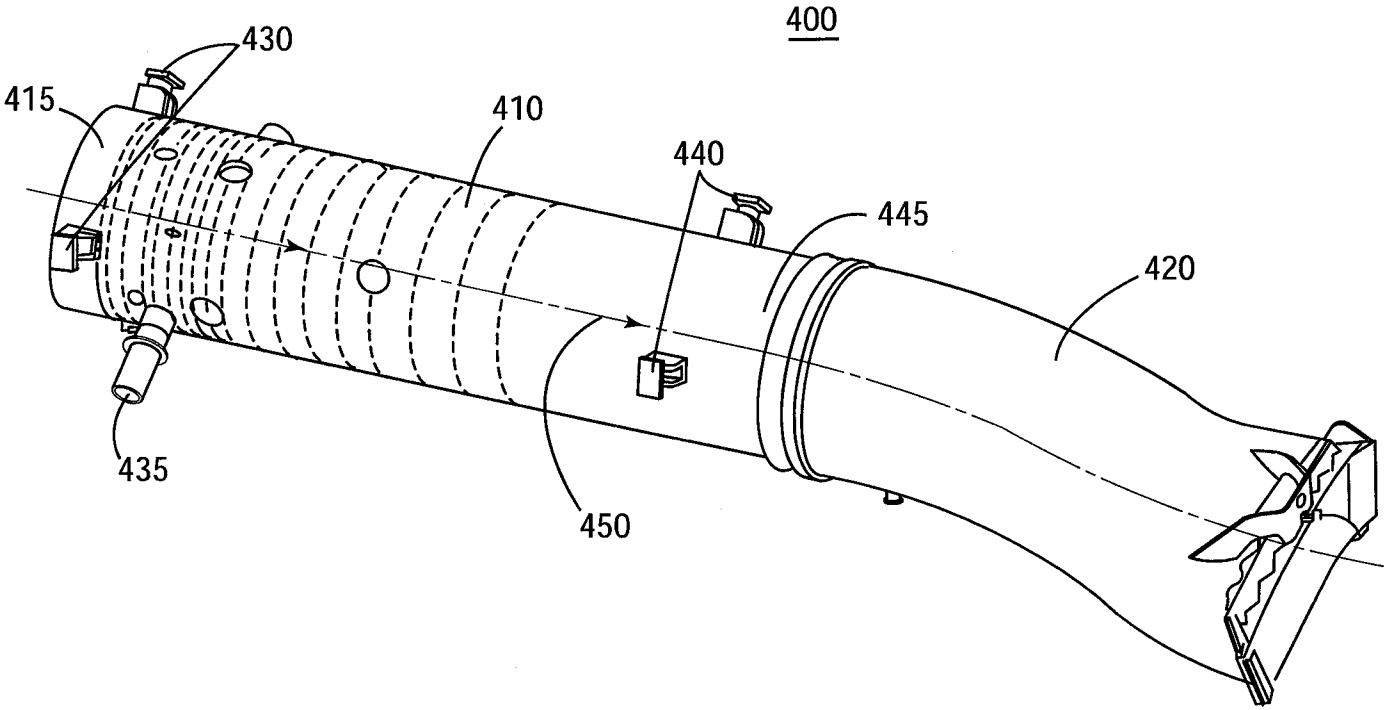
FIG. 4 is a schematic partial diagram of a gas turbine according to an exemplary embodiment.

According to an exemplary embodiment, FIG. 4 is a schematic partial diagram of a gas turbine 400. In FIG. 4, a liner 410 is connected to a hula seal 420. The liner 410 is supported close to an upstream (stop) end 415 by a liner stop mechanism 430 having at least three individual supports (two shown in FIG. 4). The fuel is input through a gas nozzle (not shown), connected to a cross fire tube 435.

A liner aft end support mechanism 440 supports an aft end 445 of the liner 410, the aft end being located downstream in a flow direction 450 from the upstream end. The flow direction 450 may be a straight line or a bended line.

The liner aft support mechanism 440 has at least three individual supports (two shown in FIG. 4) configured to allow the aft end 445 of the liner 410 to slide in the flow direction 450, thereby accommodating changes caused by the thermal expansion. The presence of the liner aft end support mechanism 440 may reduce the load on the hula seal 420 and damp vibrations of the liner 410 during operation.

Figure 5:
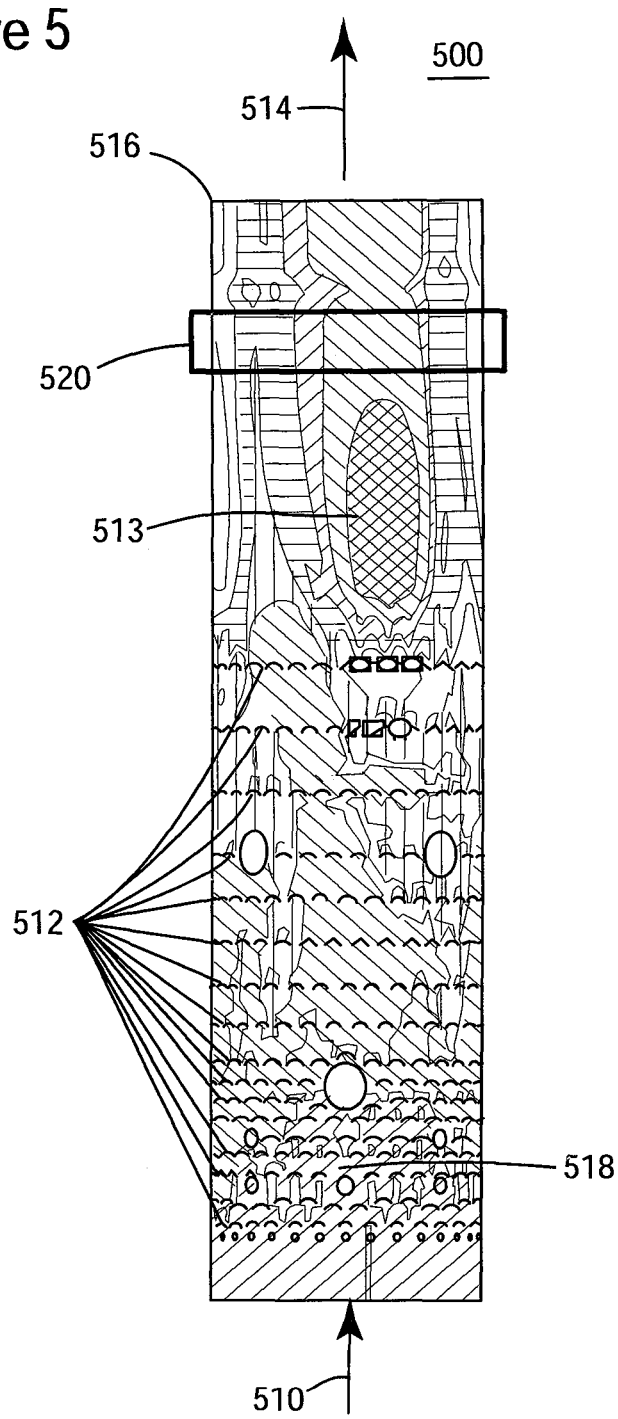
FIG. 5 is a schematic representation of a liner illustrating a location of a liner aft support mechanism according to an exemplary embodiment.

According to another exemplary embodiment, FIG. 5 illustrates a thermal analysis simulation of temperature on an outside surface of a liner 500. Compressed air 510 and fuel are input at a first end 511 of the liner 500.

The compressed air and fuel are burned in a combustion area, where the highest gas temperatures inside the liner 500 are reached. However, the temperature distribution on the outside of the liner does not mirror the temperature distribution inside of the liner 500 due to liner louvers. The liner louvers 512 are holes through walls of the liner, and are located in a portion of the liner from the first end 511 and until after the combustion area. The presence of the liner louvers cause a cooling the liner inner wall by forming a continuous thin layer of air film on an inside surface of the liner, and makes a highest temperature area 513 on the outside surface to be located downstream from the combustion area in a gas flow direction.

Exhaust gases 514 are output at a second end 516 of the liner 500. The gas temperatures decrease between the area of highest temperature 513 and the second end 516 to which a hula seal (not shown) is attached. In a cold zone 518, close to the first end 511 of the liner 500 where the compressed air and fuel are input, before the highest temperature area 513, the gas temperatures on the outer surface of the liner may be below 1000° F. (about 500° C.).

A liner aft support mechanism according to an embodiment is mounted in an area 520 which is downstream in a flow direction from the highest temperature area 513 and upstream to an area where the hula seal is connected to the liner 500. For example, when a maximum temperature in the highest temperature area 513 is around 1475° F. (about 800° C.), the temperature in the area 520 in which the liner aft support mechanism is mounted is no higher than 1400° F. (about 760° C.).

Figure 6B:
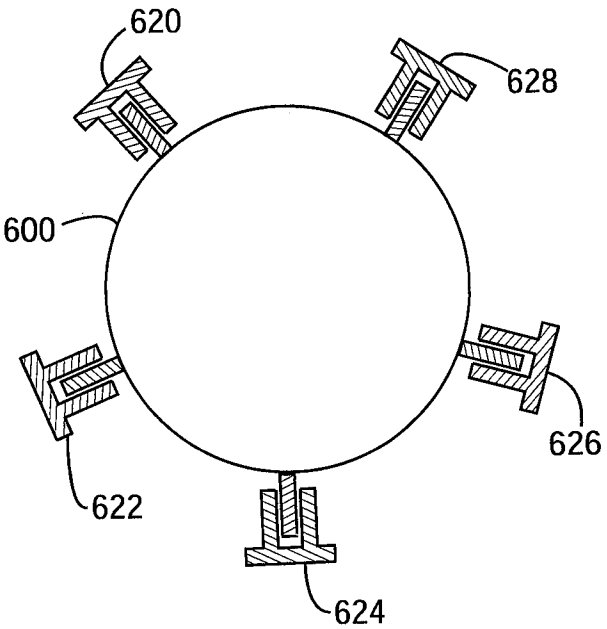
FIGS. 6A and 6B are schematic views of alternative arrangements of individual support elements of a liner aft supports mechanism according to various embodiments.
Figure 6A:
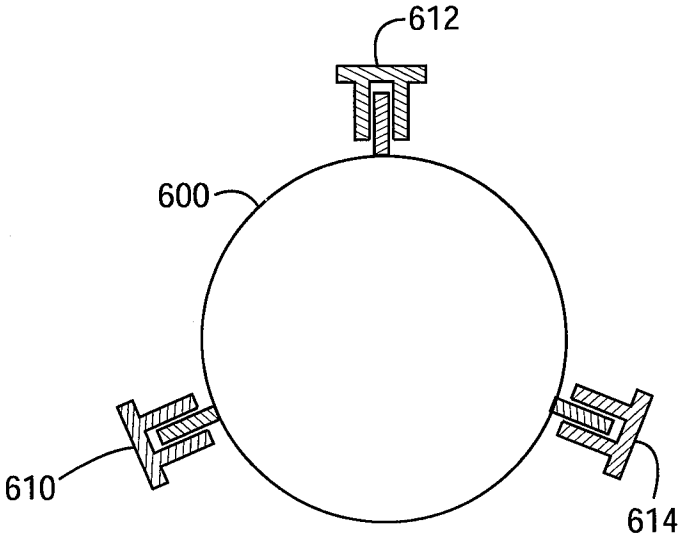

FIGS. 6A and 6B are schematic views of alternative arrangements of individual support elements of a liner aft support mechanism according to various embodiments. A liner 600 may have a circular cross-section as illustrated in FIGS. 6A and 6B. A liner aft end support mechanism may include at least three individual support elements 610, 612, and 614, as in FIG. 6A, or more than three individual support elements. For example, the liner support mechanism illustrated in FIG. 6B includes five individual support elements 620, 622, 624, 626 and 628. The number and arrangement of the individual support elements is not limited by the embodiments illustrated in FIGS. 6A and 6B.

The individual support elements may be arranged at substantially equal angles relative to a center of the liner cross-section as illustrated in FIGS. 6A and 6B. For example, for a liner support mechanism having three individual elements such as illustrated in FIG. 6A, positions of the individual support elements may be described as "12 o'clock", "4 o'clock" and "8 o'clock." The individual support elements illustrated in FIGS. 7 to 10 are alternative embodiments for the individual supports 610, 612, 614, 620, 622, 624, 626 and 628 shown in FIGS. 6A and 6B.

Figure 7:
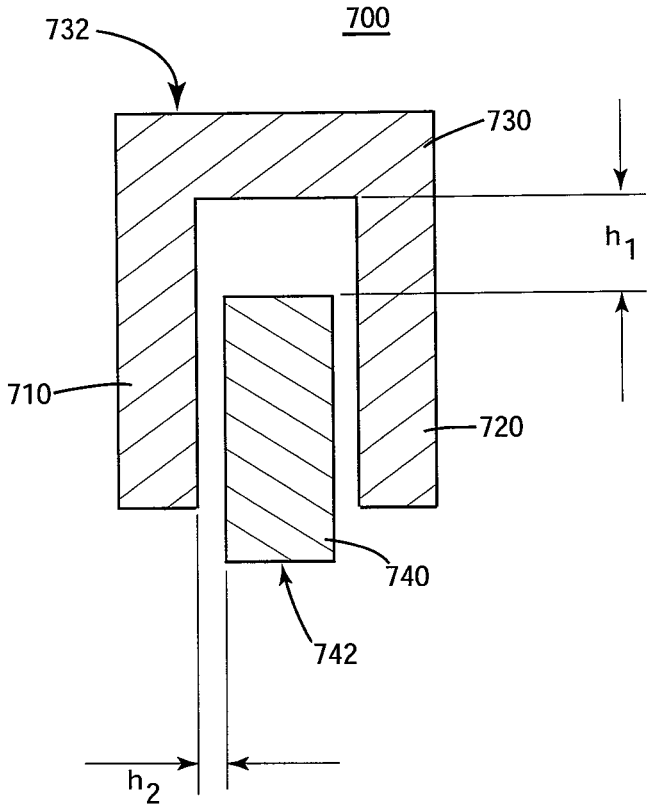
FIG. 7 illustrates an individual support element of a liner aft support mechanism according to an embodiment.

According to another exemplary embodiment, FIG. 7 illustrates an individual support element 700 of a liner aft support mechanism. The individual support element 700 illustrated in FIG. 7 is known in the art as a "male-female" individual support element. The individual support element 700 includes a female part, having a U-shape which may be formed by two plates 710 and 720 extending from a plate 730 welded to a casing (not shown) at a surface 732. The individual support element 700 also includes a male part, which may be one plate 740, welded to a liner (not shown) at a surface 742. Alternatively, the female part may be welded to the liner at the surface 732, and the male part may be welded to the casing at the surface 742.

The plate 740 is configured to slide along a flow direction (perpendicular to the figure plane) in a space between the two plates 710 and 720. A radial clearance h1 in a direction away from the liner and hoop clearances h2 (only one marked) between the plate 740 and plates 710 and 720, respectively, provide room to accommodate dimensional changes that occur due to the thermal expansion of the liner.

Figure 8:
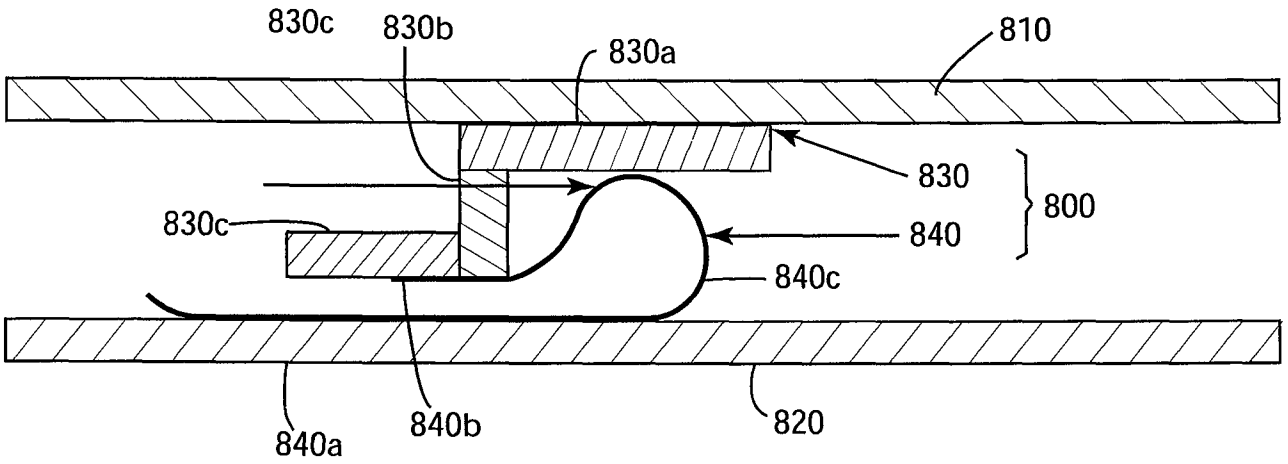
FIG. 8 illustrates an individual support element of a liner aft support mechanism according to another embodiment.

According to another exemplary embodiment, FIG. 8 illustrates an individual support element 800 of a liner aft support mechanism disposed between the casing 810 and the liner 820. The individual support 800 includes a support 830 and a spring 840.

The support 830 may have a first portion 830*a* welded to the casing 810, a second portion 830*b* connected to the first portion 830*a* and extending away from the casing 810 towards the liner 820, and a third portion 830*c* connected to the second portion 830*b* and extending in a space between the casing 810 and the liner 820. The first portion 830*a* and the third portion 830*c* may be considered to be approximately perpendicular to the second portion 830*b*. Other slopes are possible for the support 830.

The spring 840 may be made of a spring support material. In one embodiment, the spring 840 may have a first connecting portion 840*a* in moveable contact to the surface of the liner 820, and a second connecting portion 840*b* welded to the third portion 830*c* of the support 830. A middle portion 840*c* between the first connecting portion 840*a* and the second connecting portion 840*b* makes a free partial loop in a space between the liner 820 and the casing 810 thereby allowing the liner 820 to slide longitudinally relative to the casing 810. Multiple supports 830 and springs 840 may be provided between the liner 820 and the casing 810 for moveably supporting the liner 820.

Figure 9:
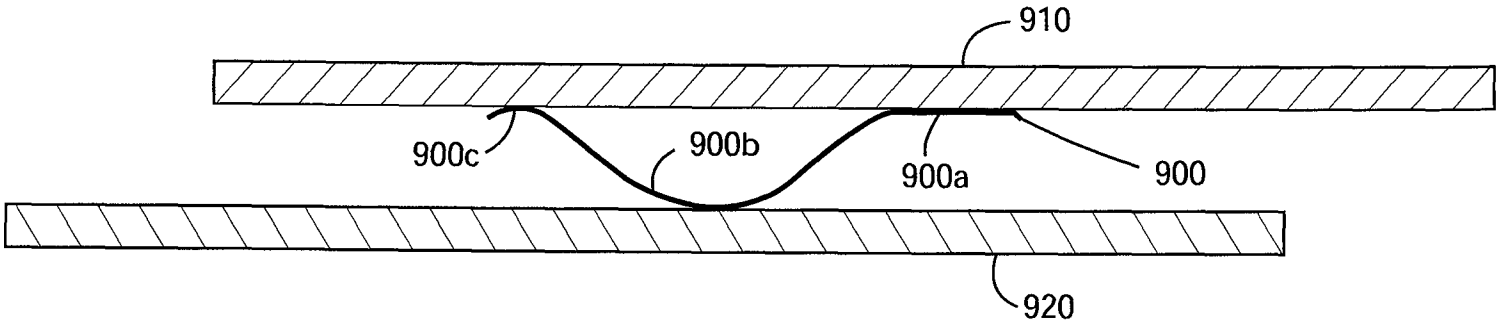
FIG. 9 illustrates an individual support element of a liner aft support mechanism according to another embodiment.

According to another exemplary embodiment, FIG. 9 illustrates an individual support element 900 of a liner aft support mechanism. The individual support element 900 may be a spring sheet waving in a space between the casing 910 and the liner 920. The individual support element 900 may have a welded portion 900*a* welded to the casing 910, a middle portion 900*b* slidably pressing on the liner 920, and an end portion 900*c* slidably pressing on the casing 910. The middle portion 900*b* is between the welded portion 900*a* and the end portion 900*c*.

Figure 10:
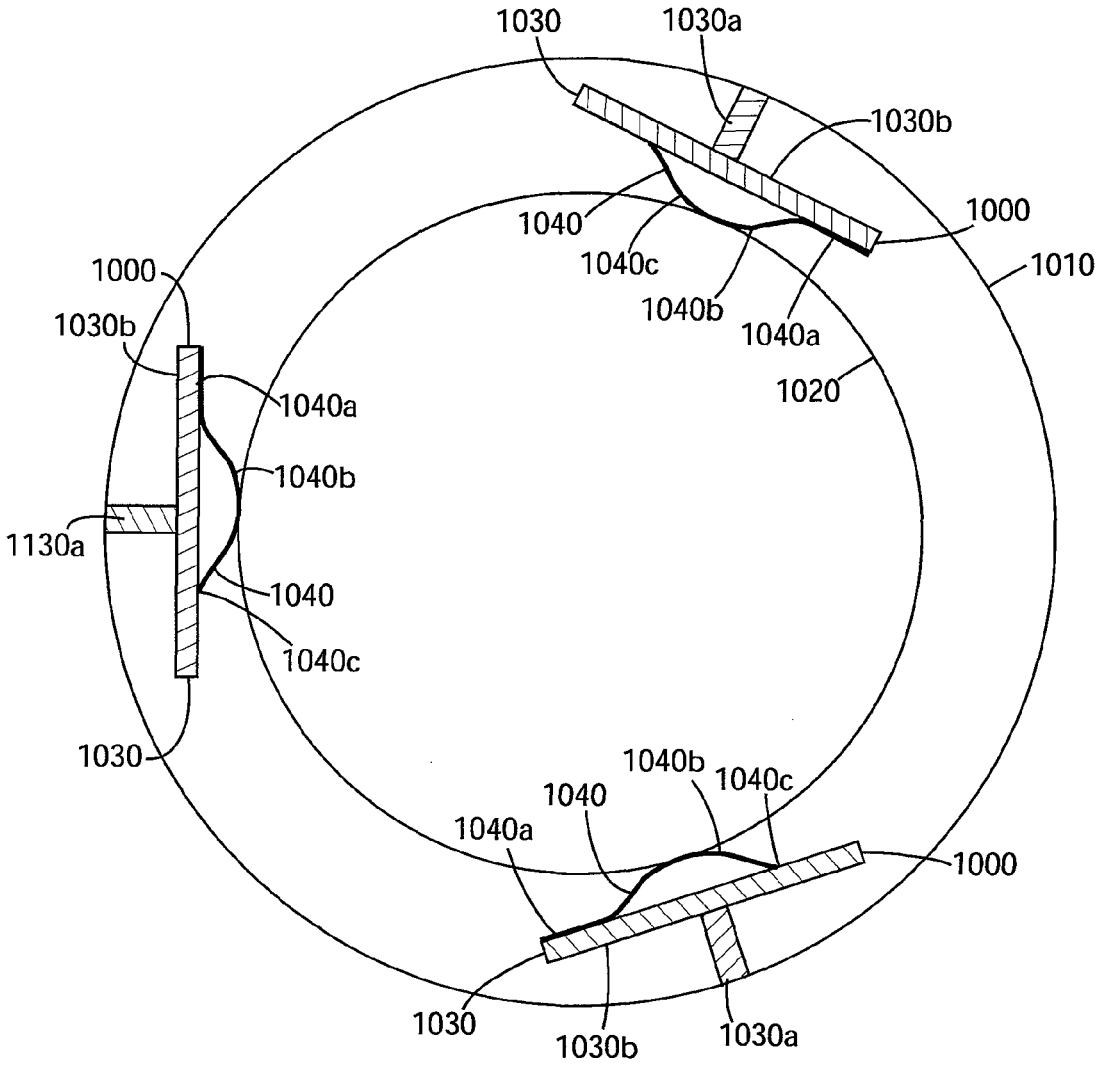
FIG. 10 illustrates a liner aft support mechanism according to another embodiment.

According to another exemplary embodiment, FIG. 10 illustrates a liner aft support mechanism. Individual support elements 1000 are located between a casing 1010 and a liner 1020. Each of the individual support elements may have a T-shaped support 1030 welded to the casing 1010, and a spring sheet 1040 waving in a space between the liner 1020 and the T-shaped support 1030.

Each T-shaped support 1030 may have a first portion 1030*a*, which is welded to the casing 1010, and extends away from the casing 1010, and a second portion 1030*b* which may be substantially perpendicular on the first portion 1030*a* and extends in a space between the casing 1010 and the liner 1020.

Each spring sheet 1040 may have a first portion 1040*a* welded to the second portion 1030*b* of the T-shaped support 1030, and a second portion 1040*b* waving in a space between the liner 1020 and the T-shaped support 1030. The second portion 1040*b* slidably presses on the liner 1020 between the first portion 1040*a* and an end portion 1040*c* slidably pressing the T-shaped support 1030.

Figure 11:
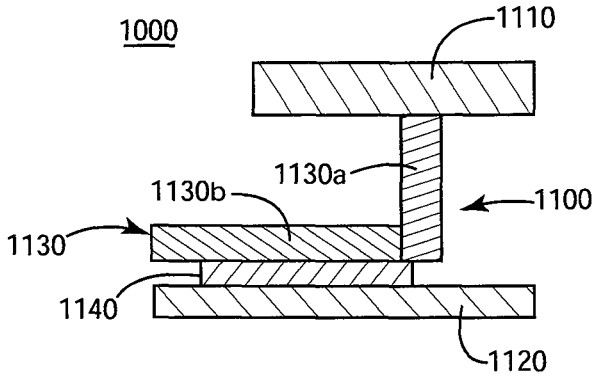
FIG. 11 illustrates an individual support of a liner aft support mechanism according to another embodiment.

According to another exemplary embodiment, FIG. 11 illustrates an individual support 1100 of a liner aft support mechanism according to another embodiment. The individual support 1100 is mounted between a casing 1110 and a liner 1120. The individual support 1000 includes a support 1130 welded to the casing 1110, and a buffer portion 1140. The support 1130 has a first part 1130*a*, which is welded to the casing 1110, and extends from the casing towards the liner 1120, and a second part 1130*b*, which is substantially perpendicular on the first part 1130*a*, and extends in a space between the casing 1110 and the liner 1120. The buffer portion 1140 is sandwiched between the second part 1130*b* of the support 1130 and the liner 1120. The buffer portion 1140 a plate welded to the liner 1120 and having a hard coating on a contacting surface with the plate 1130*b*.

Figure 12:
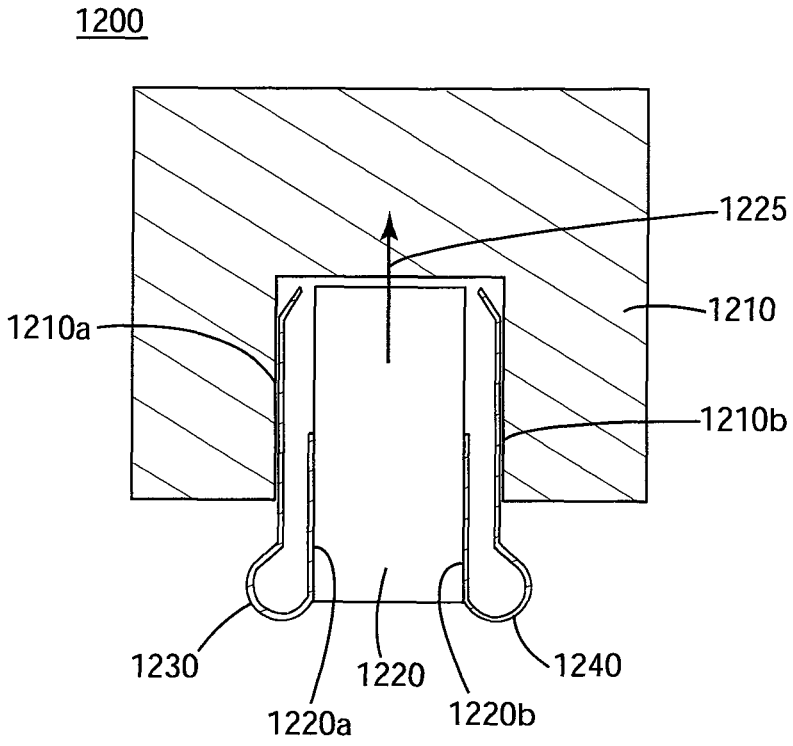
FIG. 12 illustrates an individual support of a liner stop support mechanism according to an embodiment.

According to another embodiment, FIG. 12 illustrates an individual support element 1200 of a liner stop support mechanism such as 430 in FIG. 4 or a liner aft support mechanism such as 440 in FIG. 4. The liner stop support mechanism may have at least three individual support elements disposed between a liner and a casing surrounding the liner. The liner stop support mechanism is usually located at an upstream end of the liner, close to a combustion chamber. The individual support element 1200 includes a female part 1210 having a U-shape, and a male part 1220 which is inserted in a gap in the female part 1210, in an insertion direction 1225. In order to prevent an uneven heating and wear of lateral sides 1220*a* and 1220*b* of the male part 1220 and/or lateral sides 1210*a* and 1210*b* of the female part 1210, springs 1230 and 1240 may be inserted between the male part 1220 and surfaces of the lateral sides 1210*a* and 1210*b*, respectively, of the female part 1210. The springs 1230 and 1240 exert elastic forces on respective surfaces of the male part 1220 and the female part 1210, respectively, substantially perpendicular to the insertion direction 1225. Due to the springs 1230 and 1240, a pressure is equally distributed on the surfaces 1210*a* and 1210*b*, and 1220*a* and 1220*b*, respectively.

The disclosed exemplary embodiments provide mechanisms for supporting a liner in a gas turbine engine. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A gas turbine, comprising:

a liner configured to receive compressed gas and fuel at an upstream end in a flow direction, a mixture of the compressed gas and the fuel being burned in a combustion core area of the liner, and to output exhaust gasses at an aft end opposite to the upstream end in the flow direction;

a casing configured to surround the liner;

a hula seal configured to be flexibly connected to the aft end of the liner and to receive the exhaust gasses; and a liner aft end support mechanism located downstream from an area where a highest temperature on an outer surface of the liner is attained, and upstream from a portion of the liner where the hula seal is connected to the liner, and configured to movably support the liner inside the casing, wherein the liner aft end support mechanism includes at least three individual support elements configured to allow a part of the individual support elements to move relative to at least one of the liner or the casing in the flow direction and wherein each of the individual support elements includes a spring partially welded to at least one of a casing surface or a liner surface.

2. The gas turbine of claim 1, wherein the liner aft end support mechanism includes at least five individual support elements.

3. The gas turbine of claim 1, wherein the individual support elements are arranged at substantially equal angles relative to a center of a section of the liner which includes the individual support elements.

4. The gas turbine of claim 1, further comprising:

a liner stop support mechanism located at a forward section of the liner, close to the upstream end, and upstream from the combustion core area in the flow direction, including:

at least three male-female support elements, one of a female part and a male part of the male-female support elements being welded to the casing and another one of the female part and the male part of the male-female support elements being welded to the liner, each of the male-female support elements having a first spring between a first surface of the male part and a first inner surface of the female part, and a second spring between a second surface of the male part opposite to the first surface, and a second inner surface of the female part, the first and the second springs exerting elastic forces on respective surfaces of the male part and the female part, respectively, substantially perpendicular to an insertion direction of the male part into the female part.

5. The gas turbine of claim 1, wherein each of the individual support elements includes:

an U-shaped part having a middle portion welded to one of the liner and the casing; and one plate welded to other of the liner and the casing, the one plate being configured to slide in a space inside the U-shaped part.

6. The gas turbine of claim 1, wherein each of the individual support elements includes:

a support having a first portion welded to the casing, a second portion connected to the first portion and extending away from the casing towards the liner, and a third portion connected to the second portion and extending in a space between the casing and the liner; and a spring made of a spring support material, and having a middle portion making a free partial loop in a space between the liner and the casing, the middle portion being formed between a first connecting portion in moveable contact with an inner surface of the liner and a second connecting portion welded to the third portion of the support.

7. The gas turbine of claim 1, wherein each of the individual support elements includes:

a spring sheet waving in a space between the casing and the liner, having a middle portion of the spring sheet which slidably presses on the liner, between a welded portion of the spring sheet welded to the casing, and an end portion of the spring sheet, which slidably presses the liner.

8. The gas turbine of claim 1, wherein each of the individual support elements includes:

a T-shaped support having a first portion, which is welded to the casing, extending away from the casing, and a second portion substantially perpendicular on the first portion extending in a space between the casing and the liner; and a spring sheet having a first portion welded to the second portion of the T-shaped support and a second portion waving in a space between the casing and the T-shaped support, the second portion slidably pressing on the liner between the first portion and an end portion slidably pressing on the T-shaped support.

9. The gas turbine of claim 1, wherein each of the individual support elements includes:

a support having a first part welded to the casing and extending from the casing towards the liner, and a second part, substantially perpendicular on the first part, and extending in a space between the casing and the liner; and a buffer portion which is sandwiched between the second part of the support and the liner.

10. A liner support system for a gas turbine engine, comprising:

an aft support mechanism having at least three individual support elements located between a liner and a casing close to a liner aft end of the liner, downstream from an area where a highest temperature on an outer surface of the liner is attained, and upstream from a portion where a hula seal is connected to the liner, in a gas flow direction, the individual support elements being configured to maintain support of the liner aft end, and to allow a part of the individual support elements slide in the flow direction relative to at least one of the liner or the casing and wherein each of the individual support elements includes a spring partially welded to at least one of a casing surface or a liner surface.

11. The liner support system of claim 10, wherein the individual support elements are arranged at substantially equal angles relative to a center of a section of the liner which includes the individual support elements.

12. The liner support mechanism of claim 10, further comprising:

a liner stop support mechanism located at a forward section of the liner close to the combustion section, and including at least three male-female support elements, one of a female part and a male part of the male-female support elements being welded to the casing and another one of the female part and the male part of the male-female support elements being welded to the liner, each of the male-female support elements having a first spring between a first surface of the male part and a first inner surface of the female part, and a second spring between a second surface of the male part opposite to the first surface and a second inner surface of the female part, the first and the second springs exerting elastic forces on respective surfaces of the male part and the female part, respectively, substantially perpendicular to an insertion direction of the male part into the female part.

13. The liner support mechanism of claim 10, wherein each of the individual support elements includes:

an U-shaped part having a middle portion welded to one of the liner and the casing; and one plate welded to other of the liner and the casing, the one plate being configured to slide in a space inside the U-shaped part.

14. The liner support mechanism of claim 10, wherein each of the individual support elements includes:

a support having a first portion welded to the casing, a second portion connected to the first portion and extending away from the casing towards the liner, and a third portion connected to the second portion and extending in a space between the casing and the liner; and a spring made of a spring support material, and having a middle portion making a free partial loop in a space between the liner and the casing, the middle portion being formed between a first connecting portion in moveable contact with an inner surface of the liner and a second connecting portion welded to the third portion of the support.

15. The liner support mechanism of claim 10, wherein each of the individual support elements includes:

a spring sheet waving in a space between the casing and the liner, having a middle portion of the spring sheet which slidably presses on the liner, between a welded portion of the spring sheet welded to the casing, and an end portion of the spring sheet, which slidably presses the liner.

16. The liner support mechanism of claim 10, wherein each of the individual support elements includes:

a T-shaped support having a first portion, which is welded to the casing, extending away from the casing, and a second portion substantially perpendicular on the first portion extending in a space between the casing and the liner; and a spring sheet having a first portion welded to the second portion of the T-shaped support and a second portion waving in a space between the casing and the T-shaped support, the second portion slidably pressing on the liner between the first portion and an end portion slidably pressing on the T-shaped support.

17. The liner support mechanism of claim 10, wherein each of the individual support elements includes:

a support having a first part welded to the casing and extending from the casing towards the liner, and a second part, substantially perpendicular on the first part, and extending in a space between the casing and the liner; and a buffer portion which is sandwiched between the second part of the support and the liner.

18. A gas turbine, comprising:

a compressor configured to compress air;

a turbine section downstream from the combustion chamber in a flow direction configured to receive a gas flow;

a liner fluidly connected between the compressor and the turbine section, configured to receive the compressed air and fuel, a mixture of the compressed air and fuel burning inside the liner and yielding hot exhaust gasses, the liner having an upstream end fixedly supported and an aft end opposite to the upstream end, downstream in the flow direction;

a casing configured to be fixedly connected to a gas turbine support structure and to surround the liner;

a hula seal connected to the aft end of the liner and the turbine section, configured to receive the exhaust gases from the liner; and a liner stop support mechanism located at a forward section of the liner, close to the upstream end, the liner stop support mechanism being configured to support the liner inside the casing and including at least three male-female support elements, one of a female part and a male part of the male-female support elements being welded to the casing and another one of the female part and the male part of the male-female support elements being welded to the liner, each of the male-female support elements having a first spring between a first surface of the male part and a first inner surface of the female part, and a second spring between a second surface of the male part opposite to the first surface, and a second inner surface of the female part, the first and the second springs exerting elastic forces on respective surfaces of the male part and the female part, respectively, substantially perpendicular to an insertion direction of the male part into the female part, wherein the first spring and the second spring is partially welded to at least one of a casing surface or a liner surface.

* * * * *